US011680388B2

(12) United States Patent
White

(10) Patent No.: US 11,680,388 B2
(45) Date of Patent: Jun. 20, 2023

(54) SYSTEM AND METHOD FOR COLLECTING OPERATIONAL VIBRATION DATA FOR A MINING MACHINE

(71) Applicant: Joy Global Surface Mining Inc, Milwaukee, WI (US)

(72) Inventor: Brian N. White, Brookfield, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 166 days.

(21) Appl. No.: 17/172,270

(22) Filed: Feb. 10, 2021

(65) Prior Publication Data

US 2021/0189698 A1 Jun. 24, 2021

Related U.S. Application Data

(63) Continuation of application No. 16/312,730, filed as application No. PCT/US2016/039176 on Jun. 24, 2016, now Pat. No. 10,947,703.

(51) Int. Cl.

| | |
|---|---|
| ***E02F 9/26*** | (2006.01) |
| ***E21C 35/00*** | (2006.01) |
| ***E02F 3/30*** | (2006.01) |

(52) U.S. Cl.

CPC ..... *E02F 9/267* (2013.01); *E02F 9/26* (2013.01); *E21C 35/00* (2013.01); *E02F 3/30* (2013.01)

(58) Field of Classification Search

CPC .... E02F 9/267; E02F 9/26; E02F 3/30; E21C 35/00; E21C 25/68; B60W 50/04; B60W 50/02

See application file for complete search history.

(56) References Cited

U.S. PATENT DOCUMENTS

2006/0136110 A1 6/2006 Casey et al.
2007/0006636 A1 1/2007 King et al.
(Continued)

FOREIGN PATENT DOCUMENTS

AU 2014233575 A1 10/2014
CN 102026841 A 4/2011
(Continued)

OTHER PUBLICATIONS

Bartelmus; Object and Operation Supported Maintenance for Mining Equipment; Mining Science, vol. 21, 2014, pp. 7-21 (Year: 2014).*

(Continued)

*Primary Examiner* — Michael J Zanelli
(74) *Attorney, Agent, or Firm* — Husch Blackwell LLP

(57) ABSTRACT

A system and method for collecting operational vibration data for a mining machine. The method includes, receiving at least one motion command. The method further includes, controlling at least one component based on the at least one motion command. The method further includes determining, by an electronic processor, at least one predicate parameter. The method further includes determining, by the electronic processor, whether the predicate parameter is true. The method further includes, while the at least one component is being controlled based on the motion command and the at least one predicate parameter is true, receiving, from a plurality of sensors, each of the plurality of sensors positioned at one of a plurality of measurement points on the at least one component of the mining machine, a plurality of vibration data sets.

20 Claims, 8 Drawing Sheets

(56) References Cited

U.S. PATENT DOCUMENTS

| | | | |
|---|---|---|---|
| 2013/0184927 | A1 | 7/2013 | Daniel et al. |
| 2013/0190966 | A1 | 7/2013 | Collins et al. |
| 2013/0197737 | A1 | 8/2013 | Malayappalayam Shanmugam et al. |
| 2014/0324367 | A1 | 10/2014 | Garvey, III et al. |
| 2015/0019087 | A1 | 1/2015 | Knuth et al. |
| 2015/0088372 | A1 | 3/2015 | Nower et al. |

FOREIGN PATENT DOCUMENTS

| | | | |
|---|---|---|---|
| CN | 103370859 | A | 10/2013 |
| JP | 2016105213 | A | 6/2016 |
| RU | 2436900 | C2 | 12/2011 |
| WO | 2004090486 | A1 | 10/2004 |

OTHER PUBLICATIONS

Heyns et al.; Vibration based condition monitoring under fluctuating load and speed conditions; 18th World Conference on Nondestructive testing, Apr. 16-20, 2012 (Year: 2012).*

Australian Patent Office Examination Report No. 1 for Application No. 2016410611 dated Mar. 23, 2021 (4 pages).

Intellectual Property Office India Examination Report for Application No. 201817049967 dated Apr. 1, 2021 (5 pages including English translation).

Canadian Patent Office Action for Application No. 3,028,620 dated May 10, 2021 (4 pages).

Chinese Patent Office Action and Search Report for Application No. 201680088350.5 dated Jul. 5, 2021 (10 pages including brief English summary).

Chilean Patent Office Second Office Action for Application No. CL201803727 dated Oct. 30, 2020 (26 pages including statement of relevance).

Office Action issued by the Swedish Patent Office for Application No. 1950077-6 dated Sep. 17, 2020 (4 pages).

Russian Patent Office Action for Application No. 2019101789 dated Jan. 14, 2020 (15 pages including English translation).

Chilean Patent Office Examination Report for Application No. 201803727 dated Apr. 28, 2020 (14 pages including statement of relevance).

Swedish Patent and Registration Office action for Application No. 1950077-6 dated Dec. 18, 2019 (7 pages).

Translation of Office Action issued by the Colombian Patent Office for Application No. 2019/0000659 dated Jun. 26, 2020 (7 pages).

International Search Report and Written Opinion for Application No. PCT/US2016/039176 dated Mar. 20, 2017 (14 pages).

International Preliminary Report on Patentability for Application No. PCT/US2016/039176 dated Jan. 3, 2019 (13 pages).

* cited by examiner

SYSTEM AND METHOD FOR COLLECTING OPERATIONAL VIBRATION DATA FOR A MINING MACHINE

RELATED APPLICATIONS

This application is a continuation of U.S. patent application Ser. No. 16/312,730, filed Dec. 21, 2018, which is a national stage filing under 35 U.S.C. 371 of International Application No. PCT/US2016/039176, filed Jun. 24, 2016, each of which is hereby incorporated by reference in their entirety.

FIELD

Embodiments of the invention relate to systems and methods for performing vibration monitoring for industrial machines, including mining machines.

BACKGROUND

Mining shovels, such as electric rope or power shovels, are used to remove material from, for example, a bank of a mine. An operator controls a shovel during a dig operation to load a dipper with materials. The operator deposits the materials contained in the dipper at a dumping location, such as into a haul truck, into a mobile crusher, onto an area on the ground, onto a conveyor, etc. After unloading the materials, the dig cycle repeats as the operator swings the dipper back to the bank to perform additional digging. At a mine site, especially when the production commodity price is high, every hour of downtime for a mining machine can result in a significant amount of lost revenue. Such lost revenue can be avoided by monitoring the mining shovel's operations to detect incipient faults before they develop into a more catastrophic failure.

SUMMARY

Vibration data can be used to identify a variety of machinery problems (for example, rolling element bearing defects, gear problems, imbalance, looseness, resonance, pump cavitation, electrical issues, lack of lubrication, belt problems, and the like). Accordingly, condition monitoring programs for mining operations often employ vibration monitoring on rotating equipment onboard large mobile equipment, such as an electric mining shovel. Because offline vibration monitoring can result in costly downtime, online vibration data acquisition systems have been developed.

Vibration monitoring data can be used to enact rules-based alerts that indicate when a component or components of an electric mining shovel require maintenance, repair, or replacement. Successful use of rule-based alerts may be dependent on consistent data quality, which may stem from consistent machine conditions (e.g., a relatively steady state and load). However, the nature of a highly dynamic machine like an electric mining shovel (for example, variable speed, variable load, and frequent shock events) makes it challenging to collect consistent data, and inconsistent data can lead to frequent false-positive events. Also, current vibration monitoring systems may be dependent on repeatable machine conditions that are not always possible during active mining operations.

Accordingly, embodiments described herein provide systems and methods for collecting vibration data for a mining machine.

For example, one embodiment provides a mining machine including a plurality of sensors, each of the plurality of sensors positioned at one of a plurality of measurement points on at least one component of the mining machine. The mining machine further includes a first electronic processor coupled to the at least one component and configured to receive at least one motion command, and control the at least one component based on the at least one motion command. The mining machine further includes a second electronic processor coupled to the first electronic processor and the plurality of sensors. The second electronic processor is configured to determine at least one predicate parameter and determine whether the at least one predicate parameter is true. The second electronic processor is further configured to, while the first electronic processor is controlling the at least one component and the at least one predicate parameter is true, receive, from the plurality of sensors, a plurality of vibration data sets.

In another embodiment the invention provides a method for collecting vibration data for a mining machine. The method includes, receiving at least one motion command. The method further includes, controlling at least one component based on the at least one motion command. The method further includes determining, by an electronic processor, at least one predicate parameter. The method further includes determining, by the electronic processor, whether the predicate parameter is true. The method further includes, while the at least one component is being controlled based on the motion command and the at least one predicate parameter is true, receiving, from a plurality of sensors, each of the plurality of sensors positioned at one of a plurality of measurement points on the at least one component of the mining machine, a plurality of vibration data sets.

Other aspects of the invention will become apparent by consideration of the detailed description and accompanying drawings.

DETAILED DESCRIPTION

Figure 1:
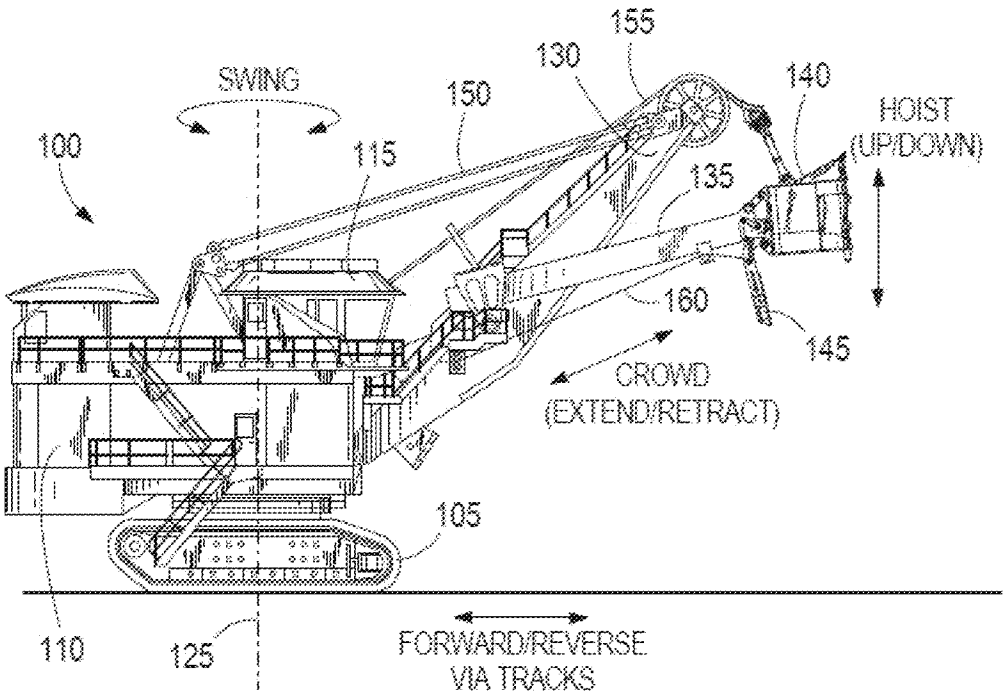
FIG. 1 illustrates an electric mining shovel according to some embodiments.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting, and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (that is, stored on non-transitory computer-readable medium) executable by one or more electronic processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. Also, "controllers" described in the specification can include processing components, such as one or more electronic processors (e.g., microprocessors, digital signal processors (DSP), field programmable gate arrays (FPGA), application specific integrated circuits (ASIC), and the like), non-transitory computer-readable memory modules, input/output interfaces, and various connections (e.g., a system bus) connecting the components.

FIG. 1 illustrates an electric mining shovel 100. The embodiment shown in FIG. 1 illustrates the electric mining shovel 100 as a rope shovel. However, in other embodiments, the electric mining shovel 100 can be a different type of mining machine, such as, for example, a hybrid mining shovel, a dragline excavator, and the like. Also, it should be understood that embodiments described herein may be used with other types of industrial machines than mining machines. The electric mining shovel 100 includes tracks 105 for propelling the electric mining shovel 100 forward and backward and for turning the electric mining shovel 100 (for example, by varying the speed, the direction, or both of the left and right tracks relative to each other). The tracks 105 support a base 110 including a cab 115. The base 110 is able to swing or swivel about a swing axis 125, which allows the shovel 100 to move from a digging location to a dumping location. In some embodiments, movement of the tracks 105 is not necessary for the swing motion. The electric mining shovel 100 further includes a dipper shaft 130 supporting a pivotable dipper handle 135 (handle 135) and a dipper 140. The dipper 140 includes a door 145 for dumping contents from within the dipper 140 into a dump location, such as a hopper or a dump truck.

The electric mining shovel 100 also includes taut suspension cables 150 coupled between the base 110 and dipper shaft 130 for supporting the dipper shaft 130; a hoist cable 155 attached to a winch (not shown) within the base 110 for winding the hoist cable 155 to raise and lower the dipper 140; and a dipper door cable 160 attached to another winch (not shown) for opening the door 145 of the dipper 140. In some instances, the electric mining shovel 100 is a P&H® 4100 series shovel produced by P&H Mining Equipment Inc., although the electric mining shovel 100 can be another type or model of electric mining equipment.

Figure 2:
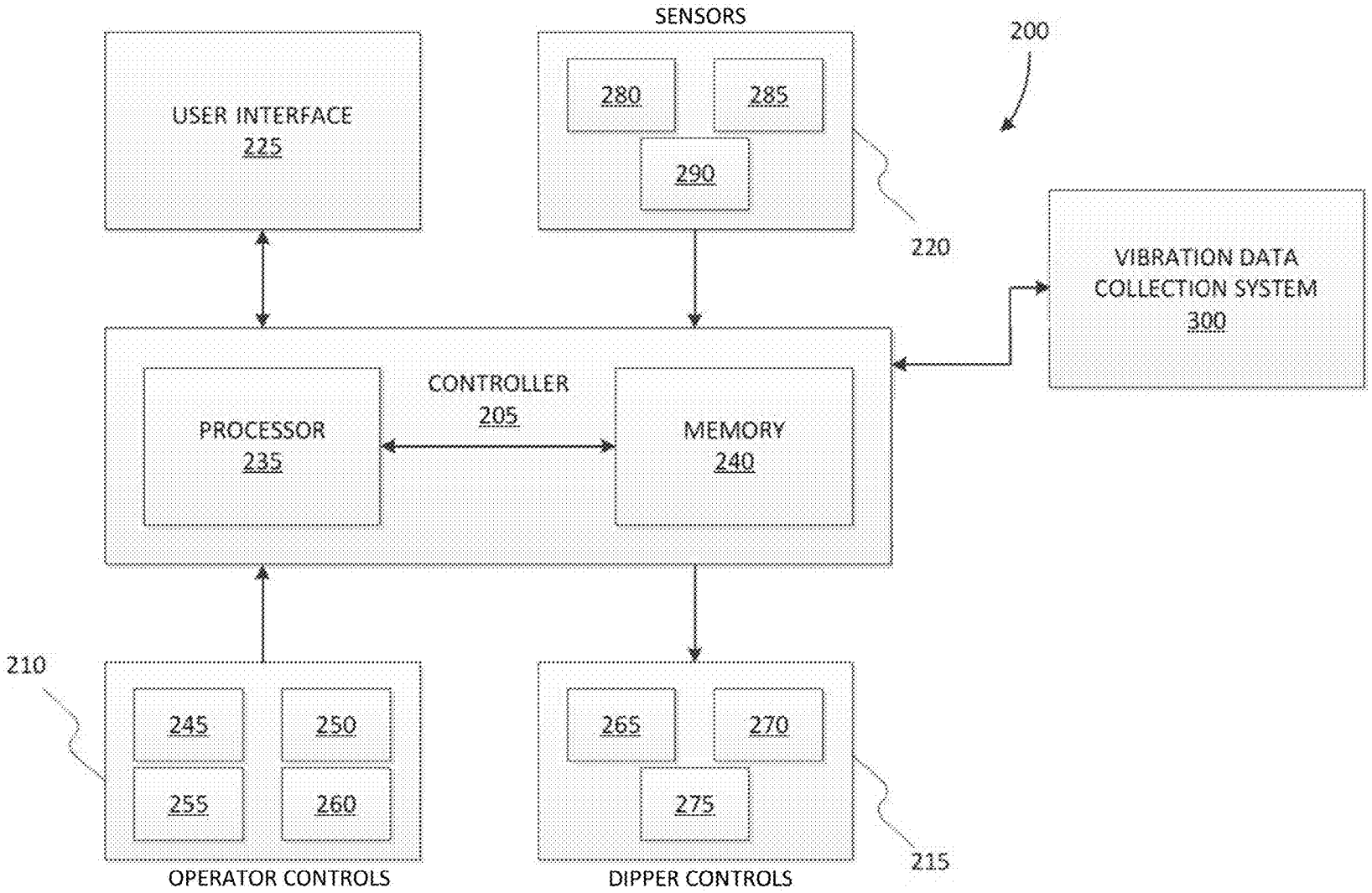
FIG. 2 is a block diagram of a control system of the electric mining shovel of FIG. 1 according to some embodiments.

When the tracks 105 of the electric mining shovel 100 are static, the dipper 140 is operable to move based on three control actions: hoist, crowd, and swing. The hoist control raises and lowers the dipper 140 by winding and unwinding hoist cable 155. The crowd control extends and retracts the position of the handle 135 and the dipper 140. In one embodiment, the handle 135 and the dipper 140 are crowded by using a rack and pinion system. In another embodiment, the handle 135 and dipper 140 are crowded using a hydraulic drive system. The swing control swivels the handle 135 relative to the swing axis 125. The electric mining shovel 100 includes a control system 200 (see FIG. 2). The control system 200 includes an electronic controller 205, one or more operator controls 210, one or more dipper controls 215, one or more sensors 220, and one or more user interfaces 225. The electronic controller 205, the operator controls 210, the dipper controls 215, the sensors 220, and the user interfaces 225 coupled directly, by one or more control or data buses, or a combination thereof. The components of the control system 200 may communicate over wired connections, wireless connections, or a combination thereof. The control system 200 may include additional, fewer, or other components and the embodiment illustrated in FIG. 2 is provided as merely one example.

The electronic controller 205 includes an electronic processor 235 (for example, a microprocessor or other electronic controller) and a memory 240. The memory 240 may include read-only memory (ROM), random access memory (RAM), other non-transitory computer-readable media, or a combination thereof. The electronic processor 235 is configured to retrieve instructions and data from the memory 240 and execute, among other things, instructions to perform the methods described herein including the methods 400 and 500 or portions thereof.

The electronic controller 205 receives input from the operator controls 210. In some embodiments, the operator controls 210 include a crowd control 245, a swing control 250, a hoist control 255, and a door control 260. The crowd control 245, swing control 250, hoist control 255, and door control 260 include, for instance, operator-controlled input devices, such as joysticks, levers, foot pedals, and other actuators. The operator controls 210 receive operator input via the operator-controlled input devices and output digital motion commands to the electronic controller 205. The motion commands may include, for example, hoist up, hoist down, crowd extend, crowd retract, swing clockwise, swing counterclockwise, dipper door release, left track forward, left track reverse, right track forward, and right track reverse.

Upon receiving a motion command, the electronic controller 205 generally controls one or more of the dipper controls 215 based on the motion command. The dipper controls 215 may include one or more crowd motors 265, one or more swing motors 270, and one or more hoist motors 275. For instance, when the operator indicates via the swing control 250 to rotate the handle 135 counterclockwise, the electronic controller 205 controls the swing motor 270 to rotate the handle 135 counterclockwise. In some embodiments, the electronic controller 205 also limits operator motion commands or generates motion commands independent of operator input.

The electronic controller 205 also communicates with the sensors 220 to monitor the location and status of the dipper 140. For example, the electronic controller 205 may communicate with one or more crowd sensors 280, one or more swing sensors 285, and one or more hoist sensors 290. The crowd sensors 280 detect a level of extension or retraction of the dipper 140. The swing sensors 285 detect a swing angle of the handle 135. The hoist sensors 290 detect a height of the dipper 140 (e.g., based on the hoist cable 155 position). In some embodiments, the sensor 220 also include one or more door latch sensors that detect whether the dipper door 145 is open or closed and measure the weight of a load contained in the dipper 140

The user interface 225 provides information to the operator about the status of the electric mining shovel 100 and other systems communicating with the electric mining shovel 100. The user interface 225 may include one or more of the following: a display screen (for example, a liquid crystal display (LCD)); one or more light emitting diodes (LEDs) or other illumination devices; a heads-up display (e.g., projected on a window of the cab 115); speakers for audible feedback (e.g., tones, spoken messages, and the like); haptic or tactile feedback devices, such as vibration devices that cause vibration of the operator's seat or operator controls 210; or another feedback device. In some embodiments, the user interface 225 also includes one or more input devices. For example, in some embodiments, the user interface 22 includes a touchscreen that performs as an output device and an input device. Embodiments of the user interface 225 may provide graphical user interfaces (GUI) for providing output to an operator, receiving input from an operator, or a combination thereof.

Figure 3:
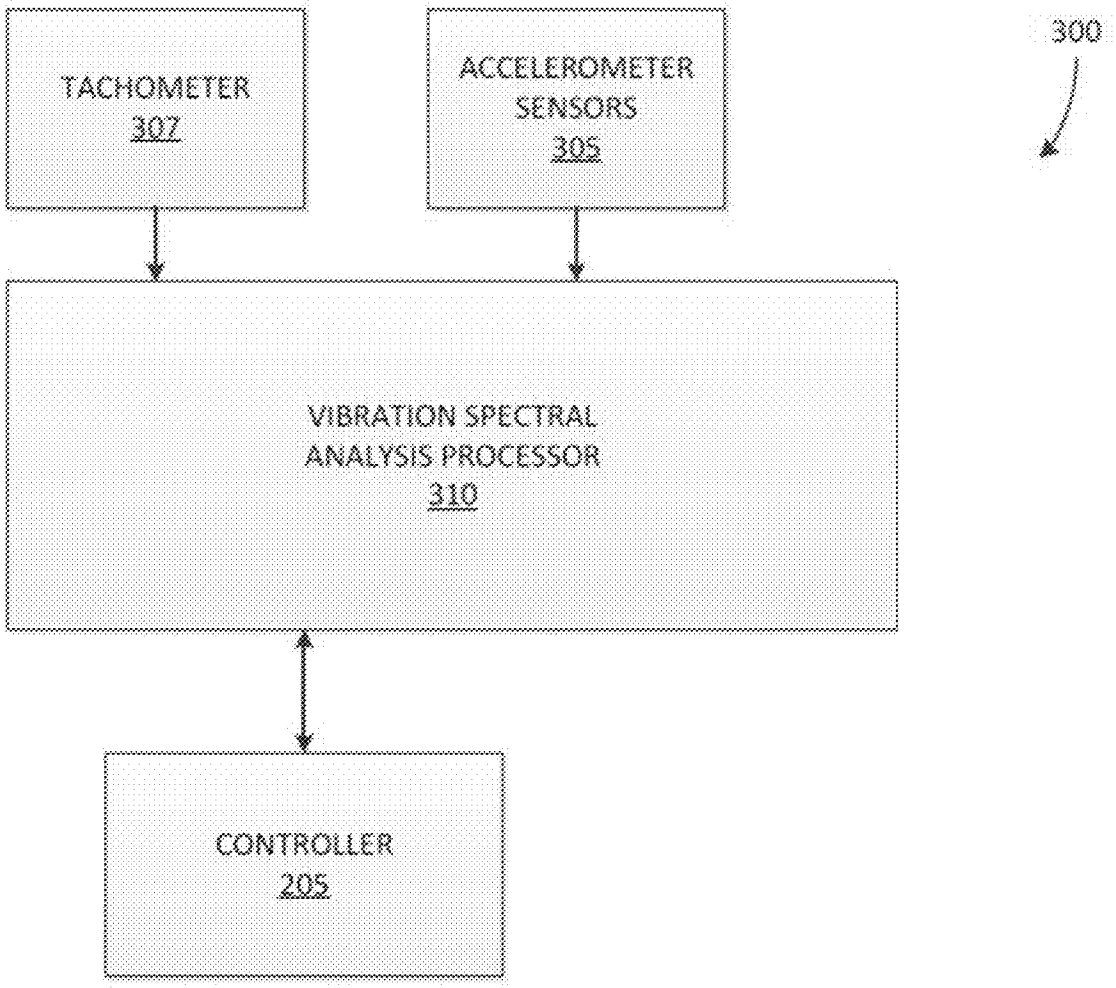
FIG. 3 is a block diagram of a vibration data collection system for the electric mining shovel according to some embodiments.

FIG. 3 is a block diagram of a vibration data collection system 300 for the electric mining shovel 100. The vibration data collection system 300 includes one or more accelerometer sensors 305, one or more tachometers 307, and a vibration spectral analysis processor 310, which are coupled directly, by one or more control or data buses, or a combination thereof over wired or wireless connections. The vibration data collection system 300 is further communicatively coupled to the electronic controller 205. The vibration data collection system 300 may include additional, fewer, or other components and the embodiment illustrated in FIG. 3 is provided as merely one example. Also, in some embodiments, functionality performed by the control system 200 and the vibration data collection system 300 as described herein may be combined and distributed in various ways. For example, in some embodiments, the control system 200 (i.e., the electronic controller 205) may be configured to perform the functionality of the vibration data collection system 300 or vice versa. The vibration data collection system 300 or portions thereof may be included in the electric mining shovel 100 or may be remote from the electric mining shovel 100. For example, in some embodiments, one or more components of the vibration data collection system 300 may communicate with one or more components of the control system 200 over a wireless connection that allows the components of the vibration data collection system 300 to be remote from the components of the control system 200.

The accelerometer sensors 305 collect vibration data of the electric mining shovel 100 while the electric mining shovel 100 is operating. The accelerometer sensors 305 measure vibrations of a structure and communicate the measured vibrations to the vibration spectral analysis processor 310. For example, in some embodiments, the accelerometer sensors 305 include piezoelectric material that produces an electric charge proportional to an exerted force caused by vibrations. The accelerometer sensors 305 may be radial accelerometer sensors or axial accelerometer sensors. Radial accelerometer sensors measure, for example, the acceleration on bearings of the electric mining shovel 100. Axial accelerometer sensors measure, for example, the acceleration on shafts of the electric mining shovel 100. In alternative embodiments, other types of sensors (for example, velocity sensors, proximity probes, and laser displacement sensors) may be used to sense vibrations.

In some embodiments, an acceleration sensor 305 is positioned at one of a plurality of measurement points on the shovel 100. Accelerometer sensors 305 may also be are arranged in groups of measurement points. Each group of measurement points is positioned to sense vibrations for a particular component or group of related components of the shovel 100, such as, for example, the one or more hoist motors 275 and pinion shafts; the hoist intermediate shafts; the hoist drum; the one or more swing motors 270 and pinion shafts; the swing intermediate shafts; the swing output shafts; the one or more crowd motors 265; the crowd input shaft; the crowd intermediate shaft, a hoist gearbox, a crowd gearbox, and a swing gearbox.

The one or more tachometers 307 detect the rotational speed and direction of the various motors of the electric mining shovel 100 and communicate the measurements to the vibration spectral analysis processor 310. In some embodiments, the one or more tachometers 307 are implemented in software.

The vibration spectral analysis processor 310 includes an electronic processor (for example, a microprocessor or other electronic controller) that executes instructions for analyzing and processing vibration data received from the accelerometer sensors 305. In some embodiments, the vibration spectral analysis processor 310 collects and processes the vibration data from the accelerometer sensors 305 in parallel. For example, the vibration spectral analysis processor 310 may coordinate the measurement starting time and sample duration for the accelerometer sensors 305 to collect vibration data sets of approximately the same duration at approximately the same time. In some embodiments, the vibration data processed by the vibration spectral analysis processor 310 includes a vibration data set that includes a time series waveform tracking the acceleration (e.g., in G forces) detected by an acceleration sensor 305 sensor over time. In some embodiments, a vibration data set must be of a desired duration to be used for some vibration analysis. Accordingly, the vibration spectral analysis processor 310 may generate a vibration data set of the desired duration by stitching together multiple shorter time series segments.

The vibration spectral analysis processor 310 may communicate the vibration data (for example, raw data or processed vibration data sets) to the electronic controller 205 (for example, for display to an operator via the user interface 225) or to an external system (for example, via a local area network, a wide area network, a wireless network, the Internet, or a combination of the foregoing (not shown)).

In some embodiments, the vibration data collection system 300 obtains vibration data during operation of the electric mining shovel 100 in a normal production environment (that is, while mining operations are taking place at a mine). Additional or alternatively, the vibration data collection system 300 obtains vibration data during "stage testing" of the electric mining shovel 100. During stage testing, the electric mining shovel 100 moves in one or more predetermined patterns (for example, hoisting the dipper 140 up and down; crowding the dipper 140 in and out; and swinging the handle 135 left and right). By moving the electric mining shovel 100 in predetermined patterns, vibration data can be captured at known points when the electric mining shovel 100 is operating at a constant speed. Also, the predetermined patterns may be repeated until sufficient vibration data is collected. One example of stage testing is described in U.S. patent application Ser. No. 13/743,894.

Figure 4:
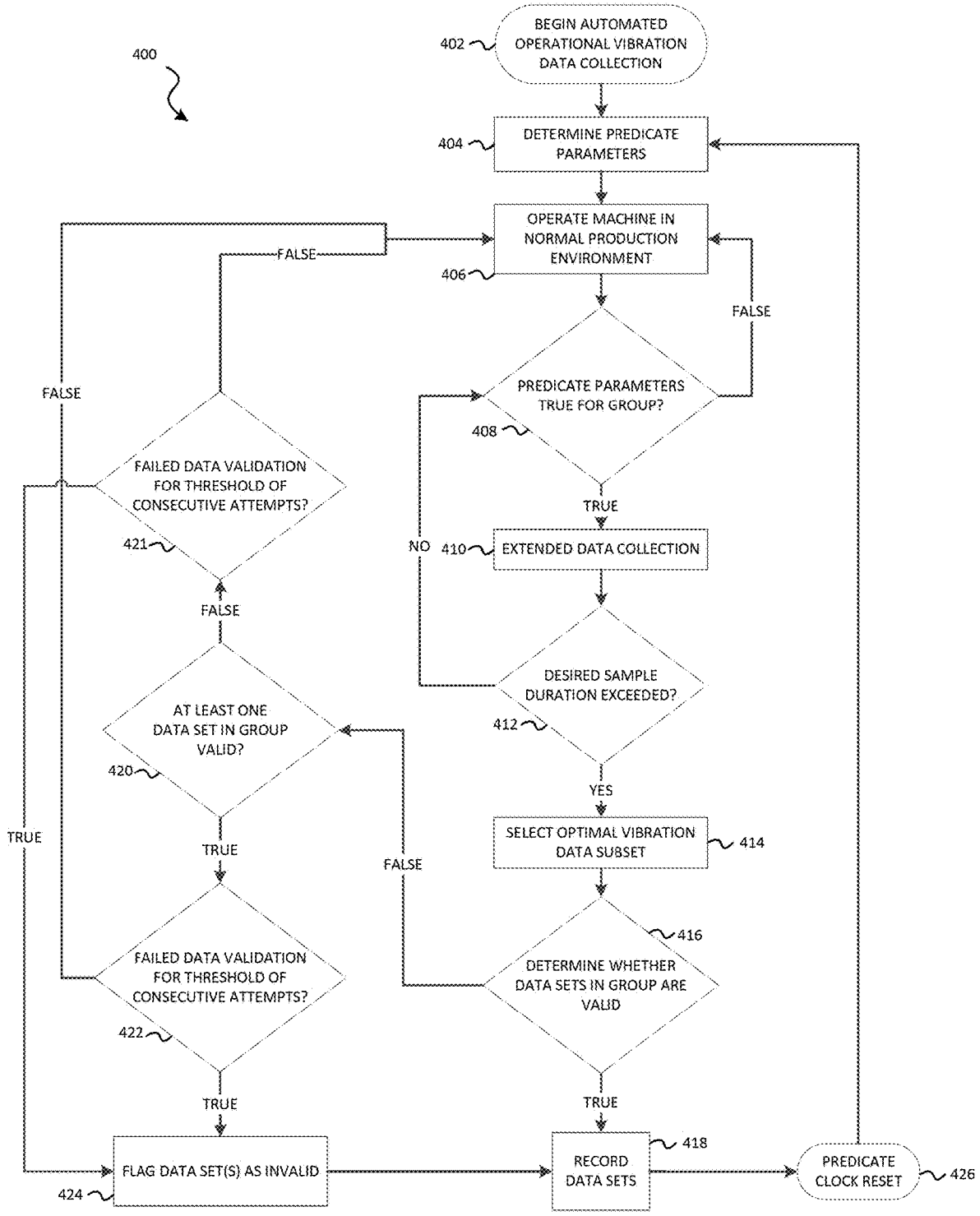
FIG. 4 is a flow chart of a method of collecting operational vibration data for the electric mining shovel of FIG. 1 according to some embodiments.

FIG. 4 illustrates a method 400 for collecting vibration data for the electric mining shovel 100 according to one embodiment. As an example, the method 400 is described in terms of a first electronic processor (for example, the electronic processor 235) that controls the operation of at least one component (for example, a crowd motor) of a mining machine (for example, the electric mining shovel 100) and a second electronic processor (for example, in the vibration spectral analysis processor 310) that collects and processes vibration data from vibration sensors (for example, the accelerometer sensors 305) positioned in a group to sense vibrations of the at least one component. This example should not be considered limiting. For example, alternative embodiments of the method 400 may be implemented using additional electronic processors or using a single electronic processor that performs all of the functions described herein.

At block 402, the second electronic processor begins the automated operational vibration data collection process. In some embodiments, the data collection process begins when the electric mining shovel 100 is powered on. In other embodiments, the data collection process does not begin until a pre-determined time has passed since the electric mining shovel 100 has been powered on or until the first electronic processor instructs the second electronic processor to begin the data collection process.

At block 404, the second electronic processor determines at least one predicate parameter. In some embodiments, the second electronic processor determines the predicate parameters by reading one or more predicate parameters from one or more configuration files stored in a memory. As explained in detail below, a predicate parameter is a condition that must be true for the second electronic processor to collect vibration data from the vibration sensors. In particular, to gather vibration data of a consistent quality, the second electronic processor preferably gathers data during consistent mining machine conditions (e.g., when the mining machine is operating at a relatively steady state and with a relatively steady load). Accordingly, the predicate parameters may specify conditions that, when true, indicate that the mining machine is operating in a steady state and load. Such predicate parameters, set forth in detail below, and the values for which such predicate parameters are true, may be determined experimentally.

At block 406, the mining machine is operated in a normal production environment (that is, during active mining operations). For example, an operator may control the mining machine to dig material from a bank and deposit the material into a dump truck. As the operator operates the mining machine, the first electronic processor receives at least one motion command and controls at least one component of the mining machine based on the motion commands. For example, the operator may control the mining machine to perform a crowd extend, and the first electronic processor receives at least one motion command to control the crowd motor to extend the handle 135 and the dipper 140. In other examples, the first electronic processor may control components of the mining machine to hoist up, hoist down, crowd retract, swing clockwise, swing counterclockwise, and the like.

At block 408, the second electronic processor determines whether the predicate parameters (determined above at block 404) are true. As noted above, the predicate parameters are conditions that, if true, are more likely to result in a consistent quality for the vibration data collected. In some embodiments, the predicate parameter or combination of predicate parameters used may depend on the group of sensors is providing vibration data sets to the second electronic processor.

One example predicate parameter is a time duration since the second electronic processor last completed vibration data collection. For example, the second electronic processor may be configured to collect vibration data every three hours during operation of the mining machine. In this situation, the predicate parameter is true when more than three hours have passed since the second electronic processor last collected vibration data and remains true until the second processor completes processing of currently collected vibration data.

Another example predicate parameter may be an operating state of at least one component or a motor that drives the at least one component. For example, a predicate parameter may include a motor rotational direction, an allowable motor speed range, an allowable instantaneous rate of change in motor speed, and an allowable sliding average rate of change in motor speed. In this situation, the predicate parameter is true when a measured value (for example, a speed, direction, or rate of change) matches or is within a predetermined range of a predetermined value for the parameter being considered. For example, in one example, the second electronic processor receives a signal from at least one tachometer (of the one or more tachometers 307) monitoring the crowd motor. The second electronic processor determines, based on the received signal, a speed and rotational direction of the crowd motor. Similarly, depending on the one or more predicate parameters determined at block 404, the second electronic processor may determine an instantaneous rate of change for the crowd motor speed and a sliding average rate of change for the crowd motor speed.

A predicate parameter may not be based on a motor speed and direction. For example, swing motor speed and direction may not provide enough information for the second electronic processor to accurately determine whether the dipper 140 is carrying a payload. In such case, the predicate parameter may include a digital machine state (for example, as derived by a cycle decomposition state machine algorithm and provided by the first electronic processor to the second electronic processor). In this situation, the predicate parameter is true for as long as the first electronic processor indicates that the mining machine is in a desired state (for example, a particular portion of the dig cycle).

Other example predicate parameters may be based on a torque for at least one component or a motor that drives the at least one component. For example, a predicate parameter may include an allowable motor torque range, an allowable instantaneous rate of change in motor torque, and an allowable sliding average rate of change in motor torque. In these situations, a predicate parameter is true when the measured value (for example, the torque or rate of change) matches or is within a predetermined range of a predetermined value for the parameter being considered. For example, the second electronic processor may receive torque values for the crowd motor from the first electronic processor. Depending on the one or more predicate parameters determined at block 404, the second electronic processor may also determine an instantaneous rate of change for the crowd motor torque and a sliding average rate of change for the crowd motor torque.

When the second electronic processor determines that one or more of the predicate parameters (determined at block 404) are false, the second electronic processor continues monitoring the predicate parameters as long as the mining machine continues to operate (at block 406).

When the second electronic processor determines that the predicate parameters (determined at block 404) are true, the second electronic processor performs extended data collection (at block 410). During extended data collection, the second electronic processor receives a plurality of vibration data sets, one from each of the plurality of sensors. The second electronic processor may receive the plurality of vibration data sets in parallel.

At block 412, the second electronic processor determines whether each of the vibration data sets exceeds a desired duration. When the vibration data sets do not exceed the desired duration, the second electronic processor continues collecting vibration data from the sensors while the predicate parameters are true (at blocks 408 through 410). In some situations, the predicate parameters may not remain true long enough to collect vibration data sets that exceed the desired duration. For example, the crowd motor may operate in and out of a desired speed range. In such situations, the second electronic processor may collect shorter segments of data and generate a vibration data set of the desired duration by stitching together a sufficient number of shorter segments of data.

At block 414, when the vibration data sets exceed the desired sample duration, the second electronic processor selects one vibration data subset from each of the plurality of vibration data sets collected. In some embodiments, the second electronic processor selects a vibration data subset to match a desired final waveform duration. For example, a one second long waveform (that is, a vibration data subset) may be selected from an initial extended waveform of approximately five to ten seconds in length (that is, a vibration data set). The second electronic processor may select the vibration data subsets based a window or windows of time with minimal parameter fluctuation such as, for example, the lowest peak motor acceleration, the lowest total fluctuation in motor speed, the lowest rate of change in motor torque, and the lowest total fluctuation in motor torque.

Figure 5:
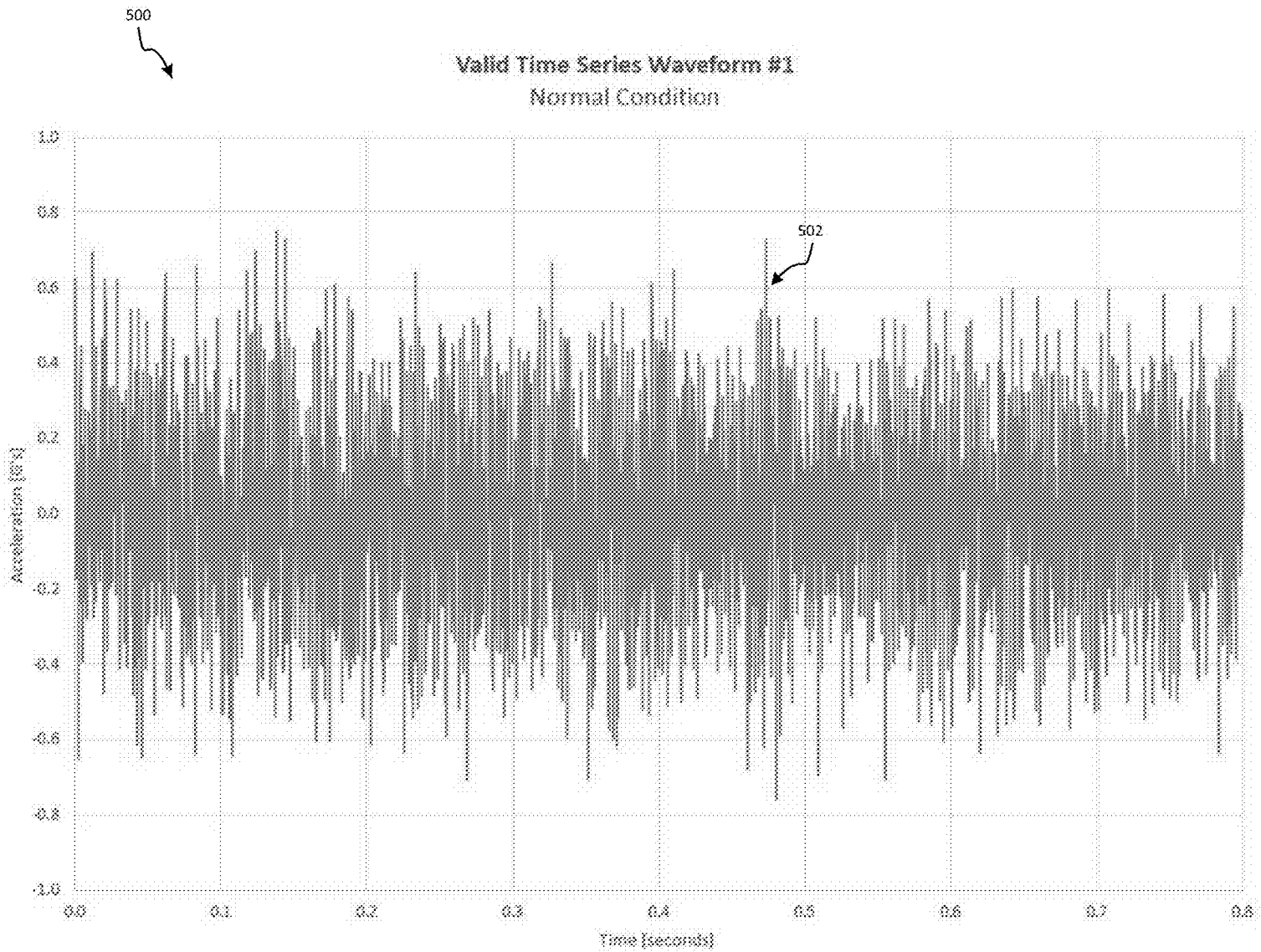
FIG. 5 is a line graph illustrating an example valid vibration data set according to some embodiments.

At block 416, the second electronic processor determines whether the vibration data sets are valid. The second electronic processor may determine data validity by testing the vibration data sets or the selected vibration data subsets. A vibration data set or subset may be valid when the vibration data set provides useful information regarding the vibration of the component being monitored. For example, FIG. 5 illustrates a chart 500 that shows a valid vibration data set 502. The valid vibration data set 502 exhibits a consistent mean at zero G forces and illustrates high-frequency energy.

Figure 6:
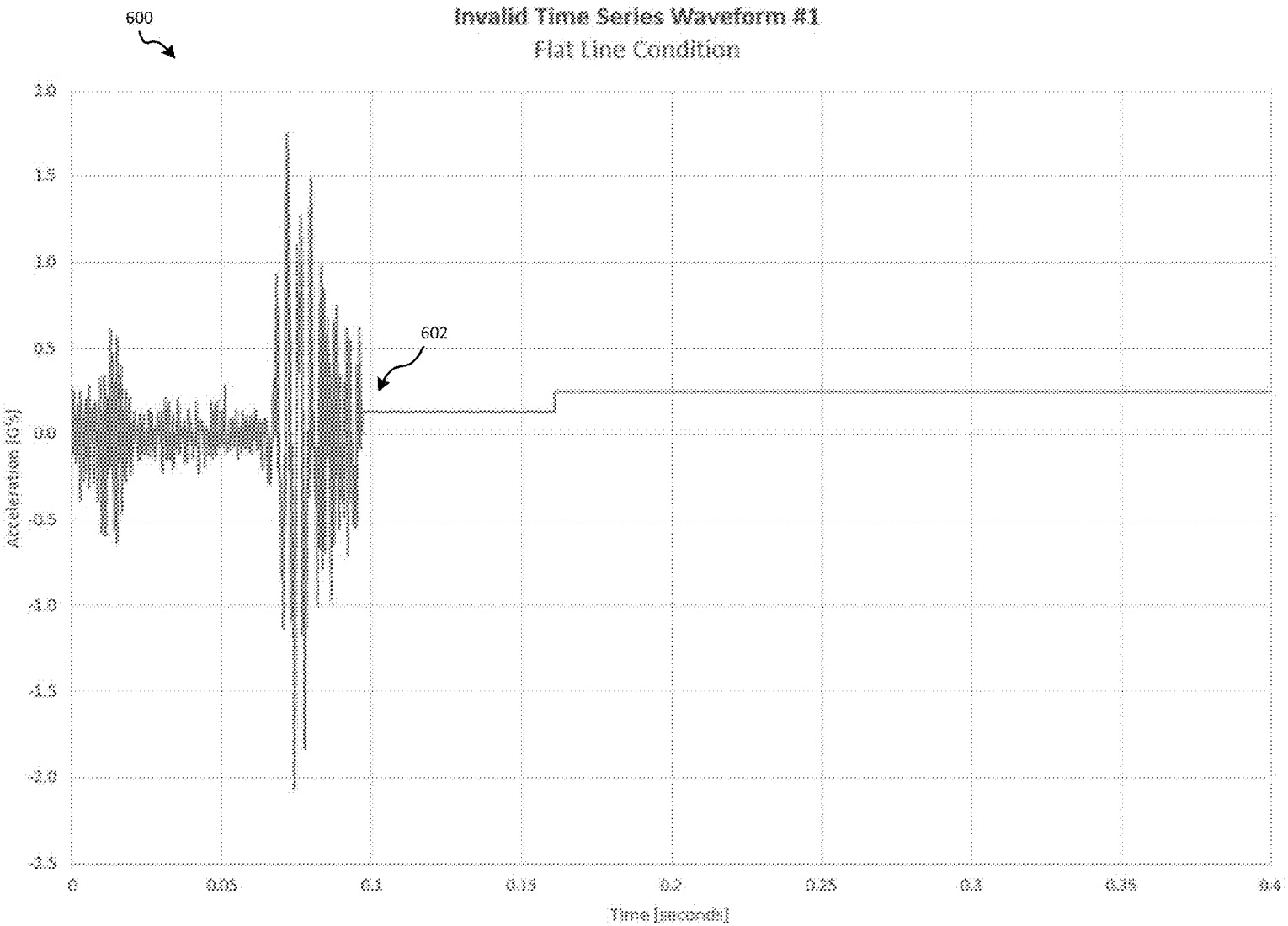
FIG. 6 is a line graph illustrating an example invalid vibration data set representing a flat line condition according to some embodiments.
Figure 7:
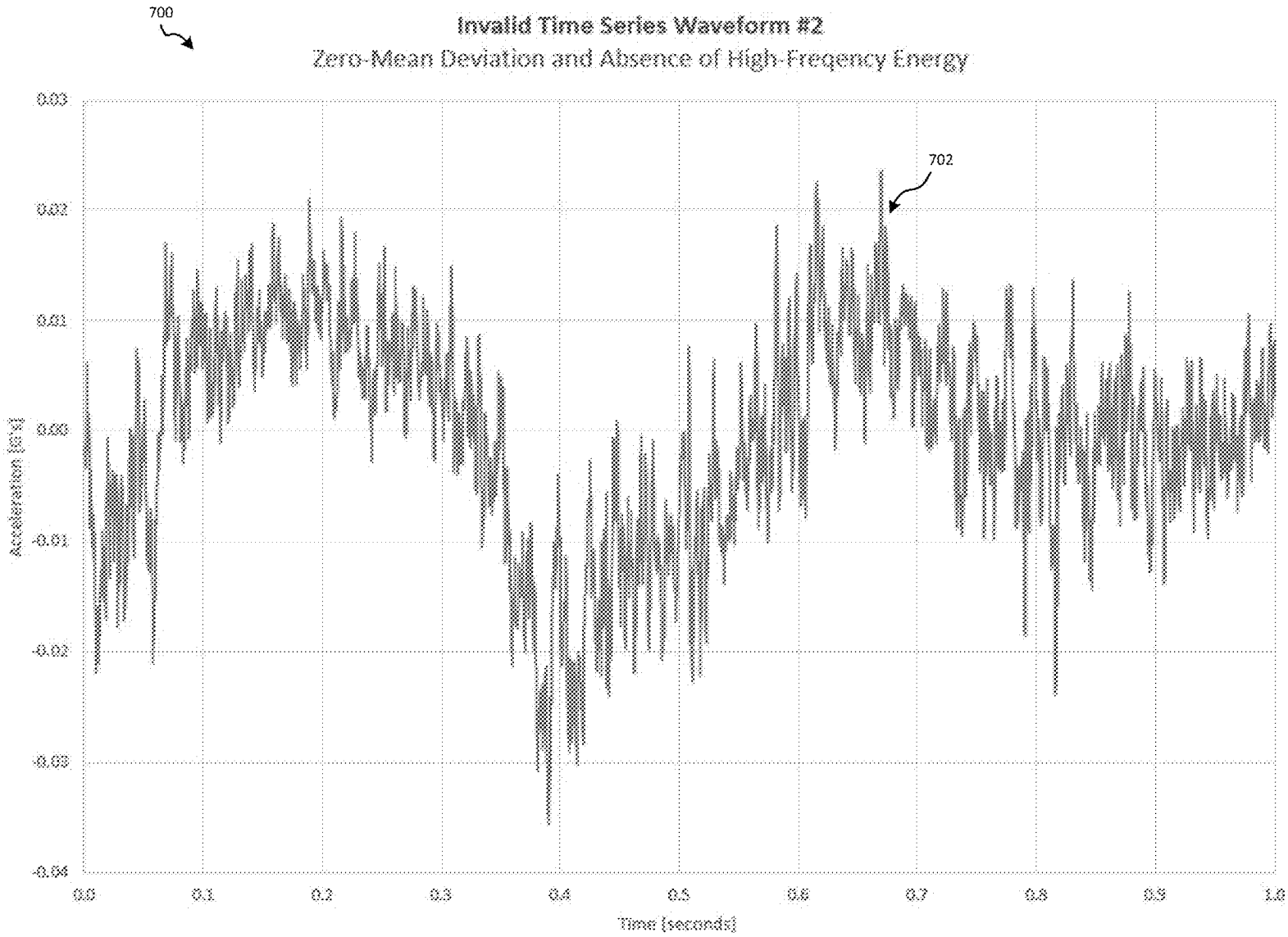
FIG. 7 is a line graph illustrating an example invalid vibration data set representing a zero-mean deviation and an absence of high-frequency energy according to some embodiments.

In contrast, a vibration data set or subset is not valid if it is unusable (that is, it will not provide useful information regarding the vibration of the component being monitored). For example, FIG. 6 illustrates a chart 600 that shows an invalid data set 602. The invalid data set 602 exhibits a wide variance in vibration (G forces) followed by a flat line. In another example, FIG. 7 illustrates a chart 700 that shows a second invalid data set 702. The second invalid data set 702 exhibits a large degree of zero-mean deviation and an absence of high-frequency energy.

Returning to FIG. 4, at block 418, when all of the vibration data sets (or subsets) are valid, the second electronic processor records the data sets (e.g., by writing the vibration data sets to a memory). In some embodiments, the second electronic processor records the vibration data sets in a memory of the vibration spectral analysis processor 310. In other embodiments, the second electronic processor records the vibration data sets in a database external to the mining machine.

At block 420, the second electronic processor determines whether at least one of the vibration data sets is valid. Consistently invalid vibration data sets received from sensors in a group may indicate, for example, that one or more predicate parameters determined at block 404 are not correct, that one or more validity test thresholds are set incorrectly, or that the sensors for that group are in need of repair or replacement. Accordingly, at block 421, when none of the vibration data sets are valid, the second electronic processor determines whether all vibration data sets have failed data validation (at block 416) for a threshold of consecutive attempts. When the threshold is not exceeded, the second electronic processor begins the vibration data collection again at block 406. When the threshold is exceeded, the second electronic processor flags the affected data sets as invalid at block 424 (for example, by writing an invalidity flag in metadata associated with the group of sensors).

Consistently invalid vibration data sets received from one or more (but not all) sensors may indicate that the one or more sensors are in need of repair or replacement. For example, the flat line response in the invalid data set 602 may indicate a transient shock event, which may temporarily saturate a sensor. In another example, the lack of high-frequency response in the second invalid data set 702 may indicate an excessive shock or a loose sensor, which impairs transmission of high-frequency energy. Such sensors will not provide valid data until the problems with them are determined and resolved. Accordingly, at block 422, when at least one vibration data set is valid, the second electronic processor determines whether invalid vibration data sets from particular sensors have failed data validation (at block 416) for a threshold of consecutive attempts. When the threshold is not exceeded, the second electronic processor begins the vibration data collection again at block 406. When the threshold is exceeded, the second electronic processor flags the affected data sets as invalid at block 424. For example, in some embodiments, the second electronic processor writes an invalidity flag in metadata associated with each affected sensor and writes the metadata to the memory with the vibration data sets (at block 418). In other embodiments, the second electronic processor sets an invalidity flag for each affected sensor in a memory and discards the invalid data sets.

Regardless of where or why the invalidity flags are written, the first or second electronic processors may read the invalidity flags and alert an operator of the mining machine (for example, but triggering an alert on the user-interface 225). Also, in some embodiments, the flags may trigger an alert on a system external to the mining machine.

At block 426, the second electronic processor may reset a predicate clock to indicate that a group of vibration data sets has been successfully collected. As described above, the second electronic processor may use the predicate clock at block 404 to determine when to begin the vibration data collection process again (i.e., how much time as passed since the last vibration data collection).

Figure 8:
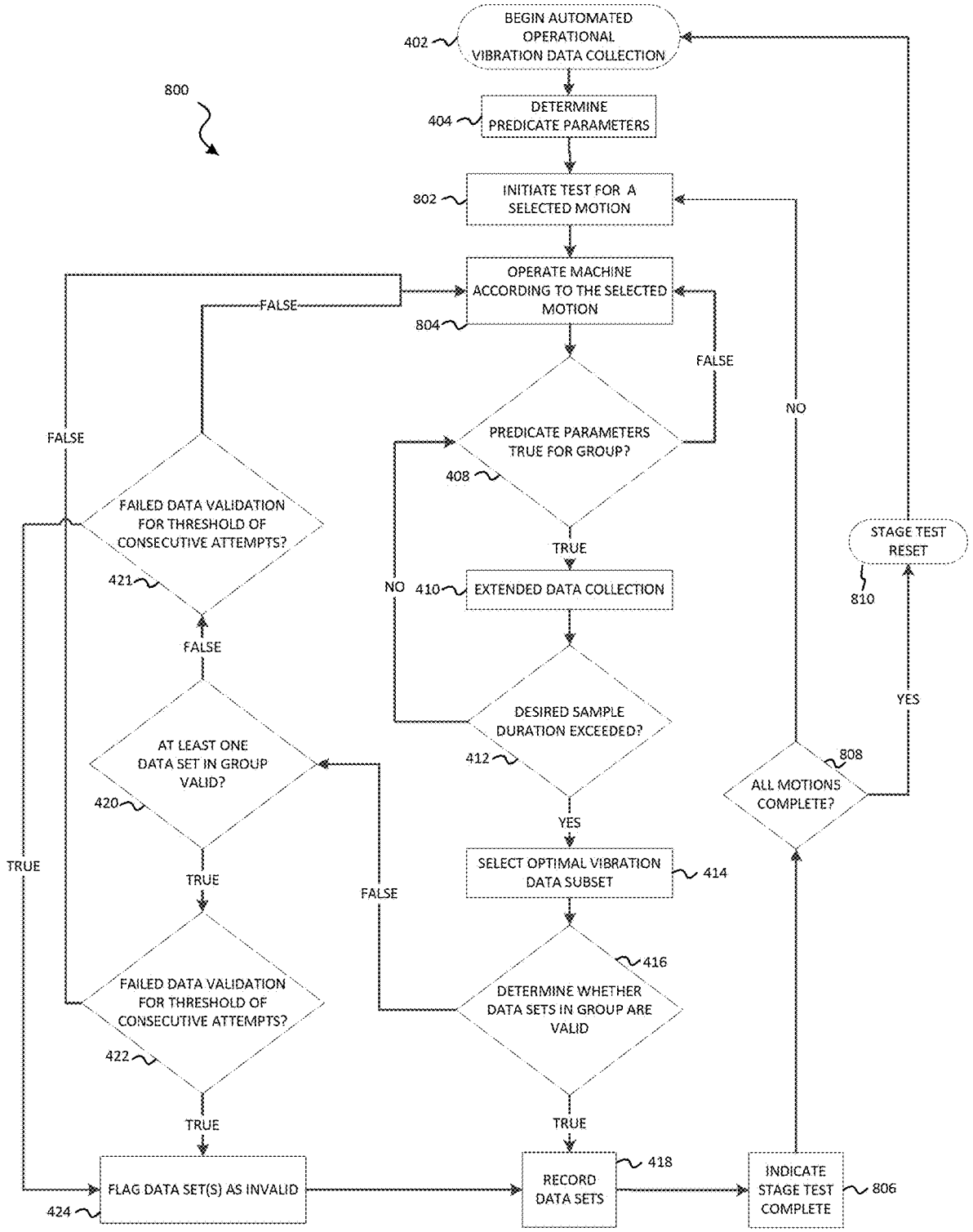
FIG. 8 is a flow chart of a method of collecting vibration data during stage testing of the electric mining shovel of FIG. 1 according to some embodiments.

As noted above, vibration data may be collected during normal operation of the mining machine or during stage testing. Accordingly, FIG. 8 illustrates a method 800 for collecting vibration data during stage testing of the mining machine according to one embodiment. In some embodiments, the method 800 is an adaptation of the method 400. Accordingly, blocks in FIG. 8 are performed as similarly labeled blocks described above with respect to the method 400. As noted above, during stage testing an operator moves the mining machine in one or more predetermined patterns (that is, motions). Accordingly, at block 802, the operator initiates a test for a selected stage test motion (for example, crowding the dipper 140 in and out). For example, the operator of the mining machine may select the motion using the user interface 225. In some embodiments, the operator selects a motion to perform. Alternatively or in addition, the second electronic processor may select a motion and display the selected motion to the operator via the user interface 225.

At block 804, the operator operates the mining machine according to the selected stage test motion, and the first electronic processor receives at least one motion command to control the mining machine to perform the stage test motion. At blocks 408 through 426, the second electronic processor collects and validates vibration data sets as described above with respect to the method 400. The operator continues to operate the mining machine according to the selected stage test motion at block 802, repeating the selected stage test motion if necessary, until the vibration data sets exceed the desired sample duration (at block 412). At block 806, the second electronic processor indicates that the stage test and the vibration data collection for that stage test is complete. In some embodiments, the second electronic processor may communicate a complete indication to the first electronic processor, which may display the indication to the operator on the user-interface 225.

At block 808, the second electronic processor determines whether selected motions have been completed. When the selected motions have been completed, the second electronic processor performs a stage test reset. In some embodiments, a stage test reset includes resetting a timer (for example, to track, similar to the predicate clock described above, how much time as passed since the last vibration data collection stage test). When the selected motions have not been completed, the second electronic processor collects vibration data for the next selected stage test motion at block 802.

Thus, the invention provides, among other things, a system and method for collecting operational vibration data for a mining machine. Various features and advantages of the invention are set forth in the following claims.

What is claimed is:

1. A mining machine comprising:

a plurality of movable components;

one or more motor operatively coupled to the plurality of movable components;

a plurality of sensors, each of the plurality of sensors positioned at one of a plurality of measurement points on at least one of the components of the mining machine; and an electronic processor coupled to the plurality of sensors and configured to receive a signal including a parameter related to a motion of at least one of the components of the mining machine, identify a steady state of the mining machine, the steady state identified based at least in part on a window of time when a fluctuation of the parameter is below a predetermined maximum value, receive, from the plurality of sensors, a plurality of vibration data sets, and select a vibration data subset from the plurality of vibration data sets corresponding to the steady state of the mining machine.

2. The mining machine of claim 1, wherein the parameter includes at least one selected from the group consisting of a motor speed, a motor acceleration, and a motor torque.

3. The mining machine of claim 1, wherein each of the vibration data sets is a waveform between five and ten seconds in length, and wherein the vibration data subset is a waveform of approximately one second long.

4. The mining machine of claim 1, wherein the electronic processor further selects the vibration data subset based on a window of time with at least one selected from the group consisting of a low peak motor acceleration, a low total fluctuation in motor speed, a low rate of change in motor torque, and a low total fluctuation in motor torque.

5. The mining machine of claim 1, wherein the electronic processor receives the plurality of vibration data sets during active mining operations.

6. The mining machine of claim 1, wherein at least one of the components is one selected from a group consisting of a hoist motor and a pinion shaft, a hoist intermediate shaft, a hoist drum, a swing motor and a pinion shaft, a swing intermediate shaft, a swing output shaft, a crowd motor, a crowd input shaft, and a crowd intermediate shaft.

7. The mining machine of claim 1, wherein the electronic processor is a first electronic processor; and further comprising a second electronic processor coupled to the first electronic processor, the second electronic processor configured to control at least one of the components, wherein the first electronic processor receives the signal including the parameter from the second electronic processor.

8. The mining machine of claim 1, wherein the plurality of sensors includes a plurality of accelerometers.

9. The mining machine of claim 1, further comprising at least one tachometer positioned to monitor at least one of the components, wherein the electronic processor is coupled to the tachometer and is further configured to receive the signal including the parameter from the tachometer.

10. The mining machine of claim 1, wherein the electronic processor is further configured to determine whether each of the plurality of vibration data sets is valid, and wherein the electronic processor is further configured to writing the plurality of vibration data sets to a memory when each of the plurality of vibration data sets is valid.

11. A method of analyzing vibration data for a mining machine, the method comprising:

receiving, by an electronic processor, a signal including a parameter related to a motion of at least one component of the mining machine, wherein one or more motor is operatively coupled to the at least one component;

identifying, by the electronic processor, a steady state of the mining machine, the steady state identified based at least in part on a window of time when a fluctuation of the parameter is below a predetermined maximum value;

receiving, by the electronic processor, a plurality of vibration data sets from a plurality of sensors, each of the plurality of sensors positioned at one of a plurality of measurement points on at least one of the components of the mining machine; and selecting, by the electronic processor, a vibration data subset from the plurality of vibration data sets corresponding to the steady state of the mining machine.

12. The method of claim 11, wherein the parameter includes at least one selected from the group consisting of a motor speed and a motor torque.

13. The mining machine of claim 11, wherein each of the vibration data sets is a waveform between five and ten seconds in length, and wherein the vibration data subset is a waveform of approximately one second long.

14. The mining machine of claim 11, wherein selecting the vibration data subset further includes selecting the vibration subset based on a window of time with at least one selected from the group consisting of a low peak motor acceleration, a low total fluctuation in motor speed, a low rate of change in motor torque, and a low total fluctuation in motor torque.

15. The method of claim 11, wherein receiving the plurality of vibration data sets includes receiving the plurality of vibration sets during active mining operations.

16. The method of claim 11, wherein at least one of the components is one selected from a group consisting of a hoist motor and a pinion shaft, a hoist intermediate shaft, a hoist drum, a swing motor and a pinion shaft, a swing intermediate shaft, a swing output shaft, a crowd motor, a crowd input shaft, and a crowd intermediate shaft.

17. The method of claim 11, wherein the electronic processor is a first electronic processor; and wherein the first electronic processor receives the signal including the parameter from a second electronic processor, the second electronic processor configured to control at least one of the components of the mining machine.

18. The method of claim 11, wherein the plurality of sensors includes a plurality of accelerometers.

19. The method of claim 11, wherein the electronic processor is coupled to a tachometer, the tachometer positioned to monitor at least one of the components, and wherein receiving the signal including the parameter includes receiving a signal from the tachometer.

20. The method of claim 11, further comprising determining whether each of the plurality of vibration data sets is valid, and writing the plurality of vibration data sets to a memory when each of the plurality of vibration data sets is valid.

* * * * *